US005890742A

United States Patent [19]

Waller

[11] Patent Number: 5,890,742

[45] **Date of Patent: *Apr. 6, 1999**

[54] IDENTIFICATION DOCUMENT AND PERSONALIZATION AND ASSEMBLY PROCESS

[75] Inventor: Robert A. Waller, Rowlett, Tex.

[73] Assignee: Raytheon Company, Lexington, Mass.

[ * ] Notice: This patent issued on a continued prosecution application filed under 37 CFR 1.53(d), and is subject to the twenty year patent term provisions of 35 U.S.C. 154(a)(2).

[21] Appl. No.: 658,871

[22] Filed: May 31, 1996

Related U.S. Application Data

[63] Continuation-in-part of Ser. No. 608,658, Feb. 29, 1996.

[51] Int. Cl.[6] ..... B42D 15/00

[52] U.S. Cl. ..... 283/67; 283/75

[58] Field of Search ..... 283/70, 67, 74, 283/75, 76, 77, 95, 72; 156/1, 196, 220

[56] References Cited

U.S. PATENT DOCUMENTS

| | | |
|---|---|---|
| 3,237,331 | 3/1966 | Gill, Jr. . |
| 3,801,183 | 4/1974 | Sevelin et al. . |
| 3,827,726 | 8/1974 | McVoy et al. . |
| 3,898,086 | 8/1975 | Franer et al. . |
| 3,919,031 | 11/1975 | White . |
| 4,099,838 | 7/1978 | Cook et al. . |
| 4,184,701 | 1/1980 | Franklin et al. . |
| 4,287,285 | 9/1981 | Mosehauer . |
| 4,298,217 | 11/1981 | Moraw et al. . |
| 4,304,809 | 12/1981 | Moraw et al. . |
| 4,322,461 | 3/1982 | Raphael et al. . |
| 4,325,196 | 4/1982 | Gauch et al. . |
| 4,370,397 | 1/1983 | Ceintrey et al. . |
| 4,377,988 | 3/1983 | Tung et al. . |
| 4,425,421 | 1/1984 | Rutges et al. . |
| 4,464,454 | 8/1984 | Vogt . |
| 4,467,335 | 8/1984 | Schmidt et al. . |
| 4,496,618 | 1/1985 | Pernicano . |
| 4,497,872 | 2/1985 | Hoppe et al. . |
| 4,504,083 | 3/1985 | Devrient et al. . |
| 4,507,346 | 3/1985 | Maurer et al. . |
| 4,511,908 | 4/1985 | Small . |
| 4,519,155 | 5/1985 | Gallagher et al. . |
| 4,519,632 | 5/1985 | Parkinson et al. . |
| 4,523,777 | 6/1985 | Holbein et al. . |
| 4,531,765 | 7/1985 | Shulman . |
| 4,536,013 | 8/1985 | Haghiri-Therani et al. . |
| 4,544,181 | 10/1985 | Maurer et al. . |
| 4,560,426 | 12/1985 | Moraw et al. . |
| 4,564,409 | 1/1986 | Kuhl . |
| 4,579,754 | 4/1986 | Maurer et al. . |
| 4,596,409 | 6/1986 | Holbein et al. . |
| 4,629,215 | 12/1986 | Maurer et al. . |
| 4,630,891 | 12/1986 | Li . |
| 4,635,965 | 1/1987 | Vogt . |
| 4,650,283 | 3/1987 | Orensteen et al. . |
| 4,653,775 | 3/1987 | Raphael et al. . |
| 4,663,518 | 5/1987 | Borror et al. . |
| 4,673,626 | 6/1987 | Takeda et al. . |
| 4,688,894 | 8/1987 | Hockert . |
| 4,691,993 | 9/1987 | Porter et al. . |
| 4,692,394 | 9/1987 | Drexler . |
| 4,710,617 | 12/1987 | Mouchotte . |

(List continued on next page.)

*Primary Examiner*—Willmon Fridie, Jr.
*Attorney, Agent, or Firm*—Baker & Botts, L.L.P.

[57] ABSTRACT

An identification document and a method of placing personalized data (variable text and color image) directly on the identification document having a data receiving page. The method comprises the steps of: printing personalized data directly onto a silicone release coat of a release sheet; positioning the release sheet with the side containing fused toner adjacent to the adhesive of an adhesive side of a security laminate; passing the release sheet and the security laminate through a laminator to transfer the personalized data to the adhesive of the security laminate; removing the release sheet leaving the personalized data on the security laminate; and passing the security laminate and the data receiving page through a laminator to seal personalized data between the security laminate and the data receiving page.

31 Claims, 6 Drawing Sheets

U.S. PATENT DOCUMENTS 4,713,365 12/1987 Harrison .
4,728,983 3/1988 Zwadlo et al. .
4,732,410 3/1988 Holbein et al. .
4,738,949 4/1988 Sethi et al. .
4,748,452 5/1988 Maurer .
4,763,985 8/1988 Bingham .
4,765,656 8/1988 Becker et al. .
4,766,026 8/1988 Lass et al. .
4,808,509 2/1989 Vervloet et al. .
4,824,142 4/1989 Dossche .
4,869,941 9/1989 Ohki .
4,894,110 1/1990 Lass et al. .
4,896,943 1/1990 Tolliver et al. .
4,899,749 2/1990 Ohashi et al. .
4,911,478 3/1990 Oshikoshi et al. .
4,928,996 5/1990 Oshikoshi et al. .
4,968,063 11/1990 McConville et al. .
4,988,126 1/1991 Heckenkamp .
4,992,353 2/1991 Rodakis et al. .
5,002,312 3/1991 Phillips et al. .
5,011,570 4/1991 Ohbayashi .
5,080,463 1/1992 Faykish et al. .
5,096,229 3/1992 Carlson .
5,106,719 4/1992 Oshikoshi et al. .
5,122,813 6/1992 Lass et al. .
5,131,686 7/1992 Carlson .
5,135,263 8/1992 Terwel .
5,213,648 5/1993 Vermeulen et al. .
5,219,183 6/1993 McKillip .
5,244,234 9/1993 Oshima et al. .
5,250,133 10/1993 Kawamura et al. .
5,261,987 11/1993 Luening et al. .
5,267,755 12/1993 Yamauchi et al. .
5,310,222 5/1994 Chatwin et al. .
5,324,567 6/1994 Bratchley et al. .
5,350,198 9/1994 Bernecker .
5,358,582 10/1994 Koshizuka et al. .
5,366,833 11/1994 Shaw et al. .
5,380,044 1/1995 Aitkens et al. .
5,380,695 1/1995 Chiang et al. .
5,387,013 2/1995 Yamauchi et al. .
5,435,599 7/1995 Bernecker .

IDENTIFICATION DOCUMENT AND PERSONALIZATION AND ASSEMBLY PROCESS

RELATED APPLICATION

This application is a continuation-in-part application under MPEP 201.08 and 37 C.F.R. §1.53 of pending application Ser. No. 08/608,658, filed Feb. 29, 1996.

TECHNICAL FIELD

This invention relates generally to identification documents and their method of manufacture, and more particularly, to identification documents and a method of placing personalized data (including text and image) in an identification document such as a passport or identification card.

BACKGROUND OF THE INVENTION

There are usually two types of printing on identification cards and passports. The first type of printing involves background printing that includes reference and security information. For example, the reference information may include the issuing agency as well as numerical data. The security information may be in the form of a watermark, an encoded magnetic strip, numerical sequences, a holographic image, etc. The second type of printing includes "personalized data" or "variable information" such as photographic, fingerprint, signature, name, address, etc.

Personalized text and image data is placed into most current passports by printing text directly into the booklet on a data receiving page with a daisy wheel-like printer and then affixing a photograph of the passport holder to the data page. This produces a passport that is vulnerable to photo-substitution. According to many forensic experts, photo-substitution accounts for over seventy percent of the incidents of passport tampering and alteration. Recent improvements in digital printing technology offer a potential method for countering this photo-substitution threat. New digital full-color printers produce near photographic quality images and passports produced with this technology offer enhanced levels of security because the images are considerably more difficult to remove and alter as compared to the photograph counterpart.

Several means of placing the variable text and image data into the passport booklet have been proposed in the past few years. One technique is based on an insert page concept. A sheet of security paper such as that used to make currency or a special synthetic paper such as Teslin™ is pre-printed with an appropriate passport security background. The finished sheet is die cut to the dimensions of the passport creating an insert data page. This data page is positioned into the passport and then attached to the booklet via a thermal lamination process. A security laminate, which is sewn into the booklet during the fabrication process, holds the data page in the document. While this technique does provide a method of placing the variable text and color image data into the passport, it also introduces a new point of vulnerability. The entire data page can be removed from the booklet by attacking the security laminate.

SUMMARY OF THE INVENTION

In accordance with the present invention, an identification document, e.g. a passport, is prepared by a method including printing personalized data directly onto a silicone release coat of the release sheet using a printer having a maximum and minimum fusing temperature, wherein the fusing temperature of the printer is controlled such that the maximum fusing temperature is below the point that the print toner will become brittle when the printed sheet is flexed and such that the minimum fusing temperature is above the point required to adequately fuse the toner to the silicon release coat. The release sheet is positioned with the side containing fused toner adjacent to the receiving surface of a security laminate. Next, the release sheet and the security laminate are passed through a laminator thereby transferring the personalized data to the receiving surface of the security laminate. Following lamination, the release sheet is removed leaving the personalized data on the security laminate.

The present invention offers enhanced levels of passport security over previous methods because all of the primary components of the document including the security laminate and the data receiving page are sewn into the passport booklet during fabrication rather than being inserted when the variable text and data are added. The overall security of the document is greatly enhanced because neither the laminate nor the data receiving page can be removed from the passport booklet without cutting the booklet apart.

BRIEF DESCRIPTION OF THE DRAWINGS

A more complete understanding of the present invention may be had by reference to the following Detailed Description when taken in conjunction with the accompanying drawings wherein.

DETAILED DESCRIPTION OF THE INVENTION

Figure 1:
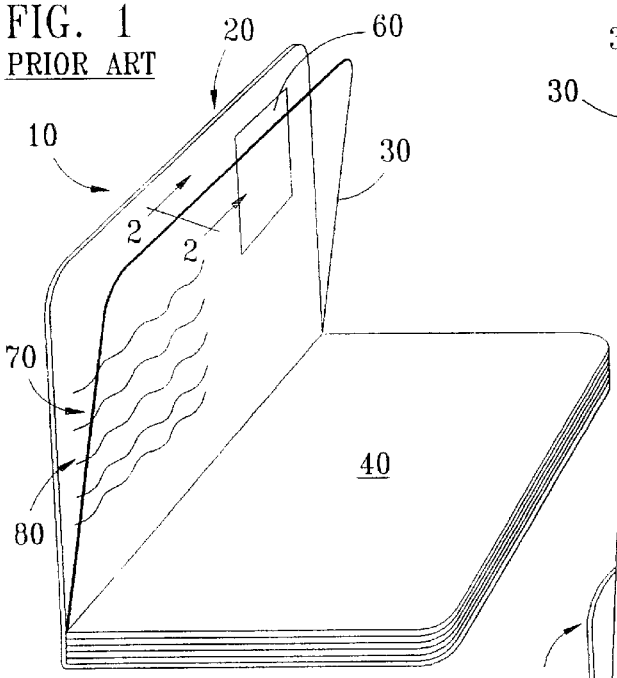
FIG. 1 PRIOR ART
FIG. 1 is a perspective view of a typical prior art passport booklet.
Figure 2:
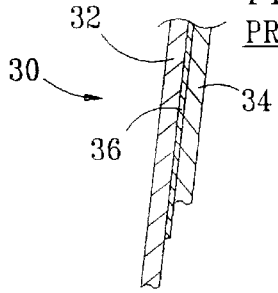
FIG. 2 PRIOR ART
FIG. 2 is an enlarged partial side section view of a security laminate page of the prior art passport booklet of FIG. 1.

Reference is now made to the Drawings wherein like reference characters denote like or similar parts throughout the 14 FIGURES. Referring to FIG. 1, therein is illustrated a current typical passport booklet 10. The current passport 10 configuration includes a data receiving page 80, usually of security paper affixed to the inside of the front cover 20, a die cut photograph 60 affixed to the data receiving page 80 and the variable text data 70 printed directly onto the data receiving page 80. A security laminate 30 is sewn into the passport booklet 10 to protect the document against wear and information substitution. After printing personalized data on the data receiving page 80 and attaching the photograph 60 to the data receiving page 80, the security laminate 30 is sealed to the receiving page 80 by passing the passport booklet 10 through a passport laminator. FIG. 2 illustrates that the typical security laminate includes a first layer of polyethylene based adhesive 32, a polyester cover 34 and a primer interface 36.

Although the description of the invention will proceed to make reference to a passport booklet, it should be understood that the invention relates to identification documents and the method of making such documents.

Figure 3:
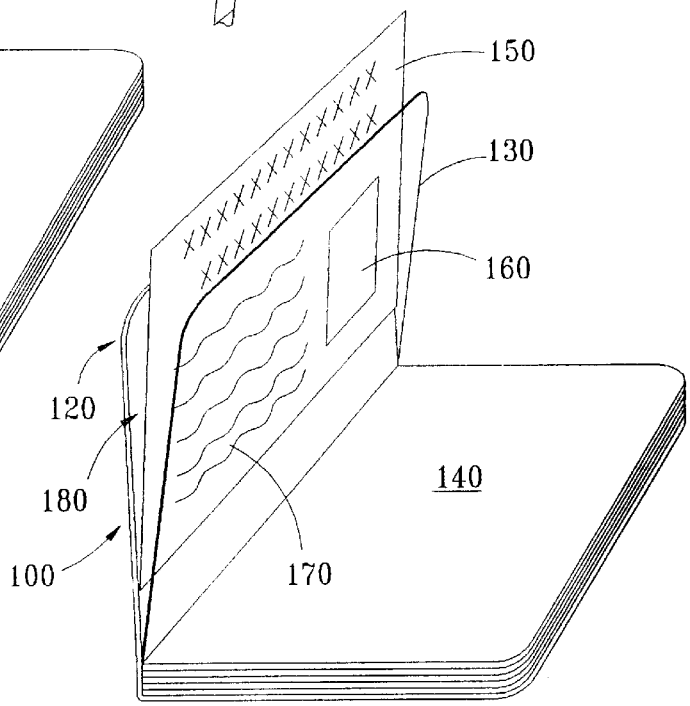
FIG. 3 is a perspective view of an identification page of a passport booklet constructed according to a first embodiment of the present invention.

Referring now to FIG. 3, the present invention offers enhanced levels of security over other methods because all of the primary components of the passport booklet 100, including the security laminate 130 and the data receiving page 180, are sewn into the passport booklet during fabrication rather than being inserted when the personalized data is added. It is understood that sewing is not the only acceptable method of affixing the elements of the passport booklet 100, any method of affixing that provides a tamper resistant means preventing the removal or replacement of pages in the passport booklet 100 is satisfactory.

Figure 4:
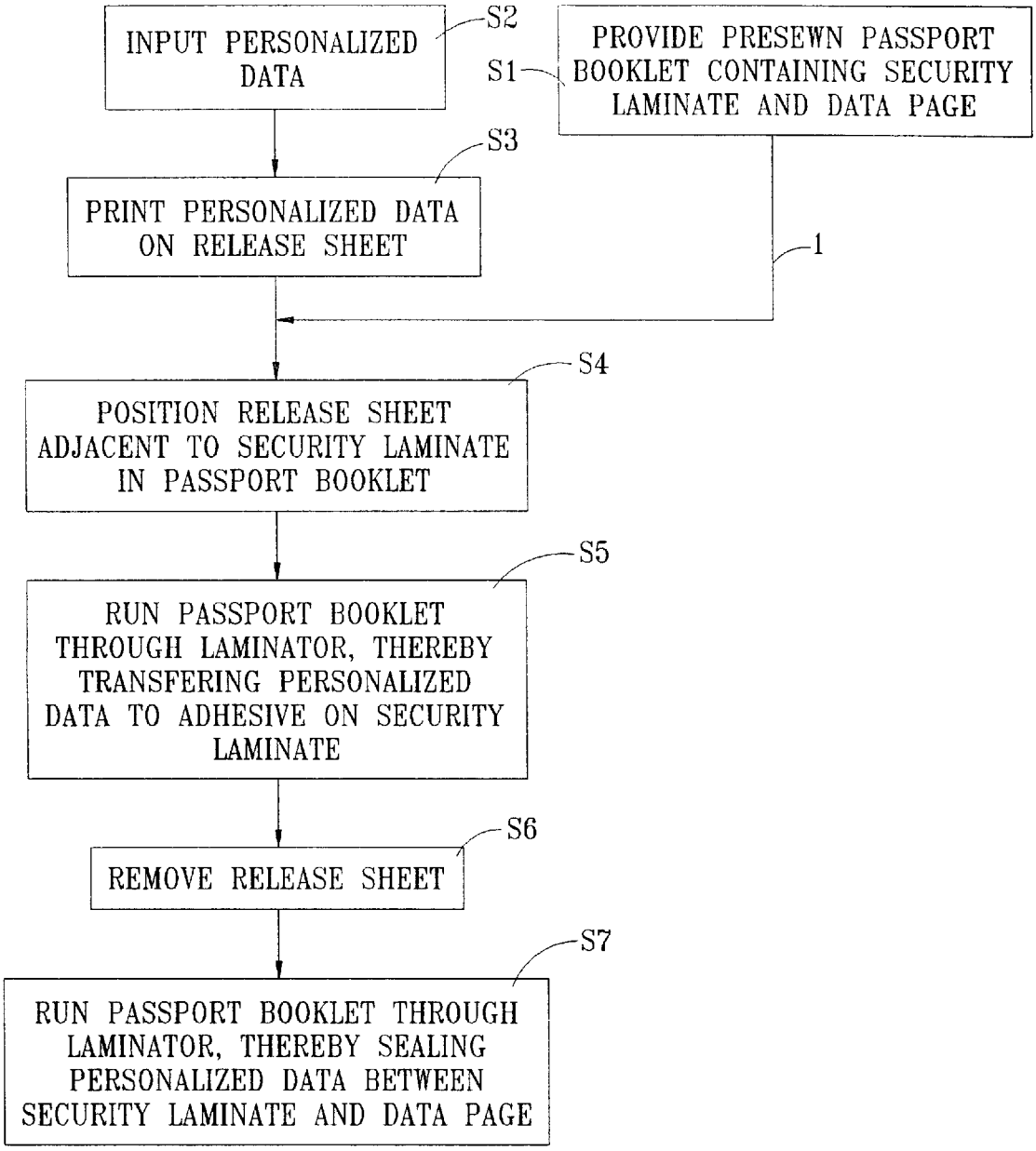
FIG. 4 is a flow chart showing the steps of the method of the present invention.

The steps employed in the method of the present invention are illustrated in FIG. 4 and described as follows. The pre-sewn passport booklet 100 herein described above and illustrated in FIG. 3 is provided in Step S1. In Step S2, formatted personalized data to be included in our identification page is input to a computer by various methods including using a scanning CCD array to read a signature or fingerprints, a computer keyboard for textual data, a scanner for scanning a photograph, a frame grabber and video camera, and/or a digital camera. The data is digitized and downloaded to a printer.

Figure 5:
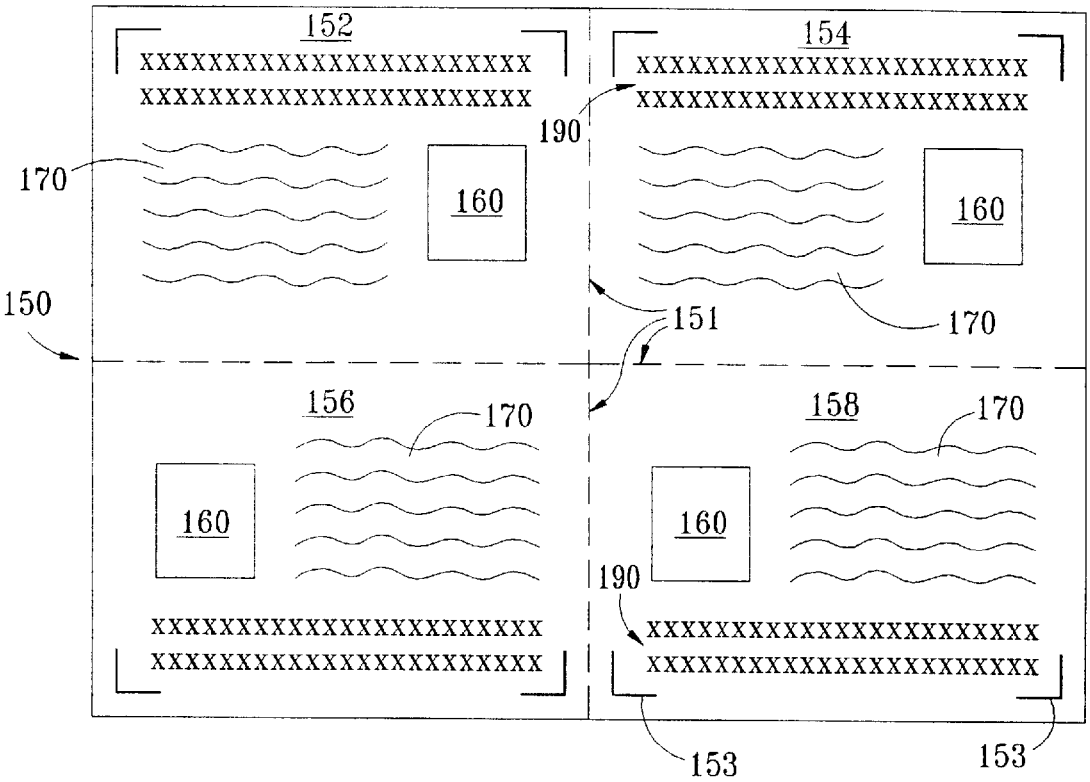
FIG. 5 is a plan view of a release sheet of the present invention after printing with personalized data for four separate individuals.

The personalized data is printed in positive image during Step S3 directly on a silicone release coat of a release sheet 150 (see FIG. 5). In one embodiment of the present invention, a black and white laser printer, such as the Hewlett-Packard Laserjet 4, was used to print black text and gray-scaled images while a color laser printer, such as the Ricoh NC5006, was used to print colored text and images. The Ricoh NC5006 prints color images and data directly onto the silicon release coat at the normal fuser roller pressures but improved quality images are achieved by slightly reducing the fuser roller temperature. Normal fusing temperatures cause the color laser toner to become brittle after fusing. This means that the toner will crack when the printed sheet is bent or flexed.

To date good results have been achieved with a WC-40 STICK-NOT™ S-Premium silicon release sheet manufactured by Release International with a basis weight of 40.0 lbs./ream. The technical data for this release paper is provided below:

PHYSICAL TEST DATA (Typical Average Values)

| Characteristic | Test Method | Nominal Value | Nominal Value |
|---|---|---|---|
| Release (12"/min) | UM-502 | 5015 gm/in | 5–15 gm/25mm |
| (1200"/min) | | 60–90 gm/in | 60–90 gm/25mm |
| Basis weight | TAPPI T-410 | 40.0 lbs/ream | 65 g/m$^2$ |
| Caliper | TAPPI T-411 | 2.75 mils | 70 microns |
| Tear Strength CD | TAPPI T-414 | 53 grams | 53 grams |
| Tensile Strength MD | TAPPI T-404 | 23 lbs/in | 4.0 kN/m |
| Brightness | TAPPI T-452 | 82.0 nm | 82.0 nm |
| MG Sheffield Smoothness | UM-518 | 2.75 SFU | 2.75 SFU |

The best quality color images were achieved with this release sheet by reducing the fuser roller temperature to ~150° C. on the Ricoh NC5006 printer. Fusing temperatures that are too high will cause the toner to become brittle and crack when the sheet is flexed and temperatures that are too low do not adequately fuse the color toner to the release surface. However, at the proper fuser roller temperature setting, the fused information can be touched and lightly rubbed without smearing or destroying the text or images. The proper fuser temperature setting is dependent upon the thermal mass and, therefore, the basis weight of the release sheet.

FIG. 5 illustrates an example configuration of a printed silicon release sheet 150 showing the layout of the variable text and image data. In this configuration, the release sheet 150 is standard letter size of 8½"×11". This size is adequate to produce four individual passport documents 152, 154, 156, 158. The sheet 150 has perforated lines 151 so that it can be easily torn into the four equal quadrants 152, 154, 156, and 158 after the printing process. Personalized data including photographic image 160, textual image 170 and OCR-B machine readable text 190 are illustrated as printed on the release sheet.

Returning to FIG. 3 and 4 in Step S4, one of the quarter sheets, for illustrative purposes sheet 152, is placed between the data receiving sheet 180 and the security laminate 130. The security laminate 130 is positioned so that the receiving surface faces the data receiving sheet 180. The release sheet 152 is positioned so that the personalized information is facing the receiving surface of the security laminate 130. When Teslin™ is used as the data receiving sheet 180, the receiving surface of the security laminate 130 will include an adhesive layer. However, it is understood that additional materials may be used for the data receiving sheet 180, including but not limited to fusible polymeric materials such as vinyl. If a fusible polymeric material is used for data receiving sheet 180 the security laminate 130 is a fusible polymeric data receiving sheet containing no adhesive layer.

Figure 6:
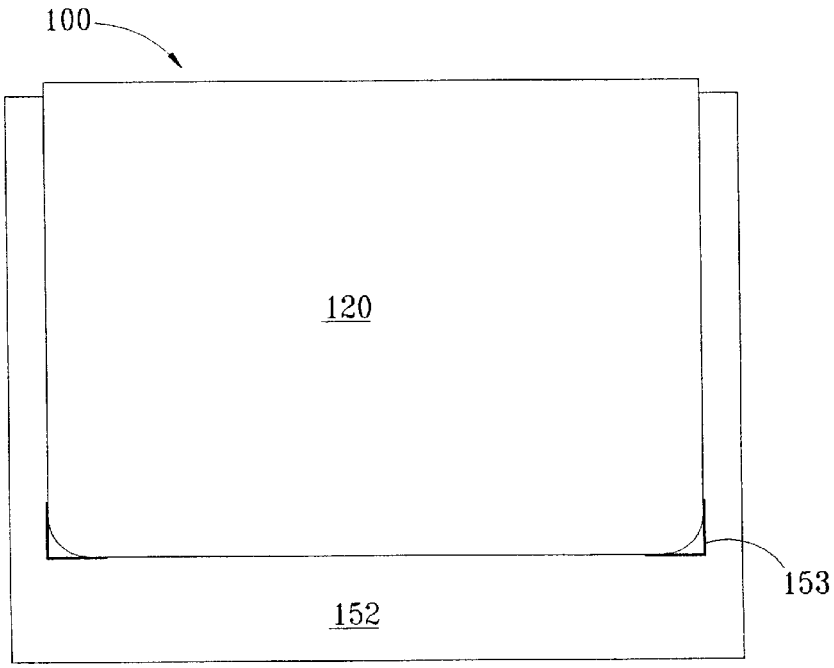
FIG. 6 is a plan view showing an alignment of the release sheet just prior to transfer of personalized information to the identification page.

Referring to FIGS. 5 and 6, alignment guides 153 are printed on each quarter sheet so that the text data 170 and image data 160 are positioned properly relative to the edges of the passport booklet 100.

The release sheet 150,including security laminate 130, is passed during Step 5S through a conventional laminator such as a 1000PLA from Thermal Laminating Corporation. The heaters are gapped to the approximate thickness of the passport booklet 100 and the temperature is adjusted to an interface temperature of 125° C. for typical polyethylene-based adhesives. The required interface temperature is dependent upon the adhesive formulation of the data receiving sheet 180 or in alternate embodiments the softening temperature of the fusible polymeric data receiving sheet.

The corresponding temperature setting on the laminator is dependent upon the thermal mass of the passport booklet 100 and, therefore, the thickness of the passport booklet 100 as well as the speed of the laminator. The laminator transfers the personalized data from the release sheet 150 to the receiving surface of the adjacent security laminate 130. The personalized data, including image and all of the text, is transferred to the receiving surface in a single pass rather than being printed directly to the laminate via a three-color or four-color print process.

While the donor release sheet 150 and security laminate 130 are still hot from the initial pass through the laminator, the release sheet 150 is peeled in Step S6 from the security laminate 130 and discarded.

After the image transfer is completed and the release sheet 150 is removed from the document, the passport booklet 100 is sent through the laminator a second time in Step S7 to seal the security laminate 130 to the fusible polymeric data receiving sheet 180. In this embodiment, the data receiving sheet 180 is attached to the inside of the cover 120.

The lamination temperature of the second pass may be different from the first pass depending on characteristics of the material used for the data receiving sheet 180 and security laminate 130. It is to be understood that as discussed in this application, the data receiving sheet 180, represents an identification document that may be located in the passport booklet 100 or alternatively in other types of identification documents. Additionally, the data receiving sheet 180 may be a completely blank security coded paper or contain pre-printed standard form information, leaving only blank space for the personalized data to be affixed. If the data receiving sheet is completely blank then the standard form information is downloaded to the printer concurrently with the personalized data and affixed concurrently as heretofore described with regard to the personalized data.

The method of the present invention is applicable to adhesive based security laminates 130 and non-adhesive based laminates with softening temperatures in appropriate ranges. Suitable adhesive based security laminates 130 include plain polyethylene hot melt adhesive as well as any number of copolymers including EAA (ethylene/acrylic acid copolymer), EEA (ethylene/ethyl acrylate copolymer), EMA (ethylene/acrylate copolymer), EVA (ethylene/vinyl acetate copolymer), and pressure sensitive adhesives (PSA). Non-adhesive based security laminates include vinyls, PETG (polyester with a glycol additive), amorphous polyesters, or any transparent polymeric material with an appropriate softening temperature.

Figure 7:
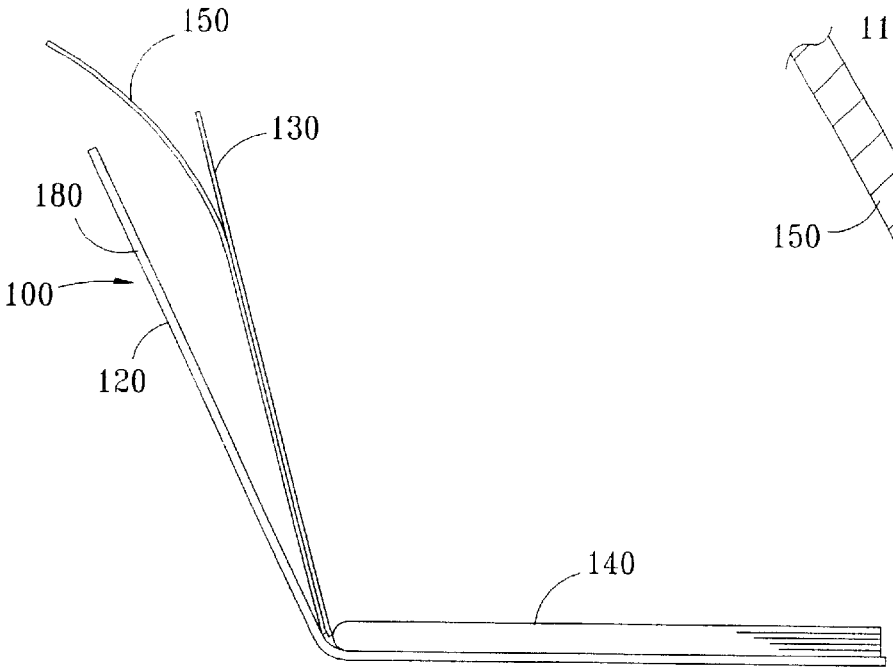
FIG. 7 is a side view of the identification page of the passport booklet of FIG. 3.
Figure 8:
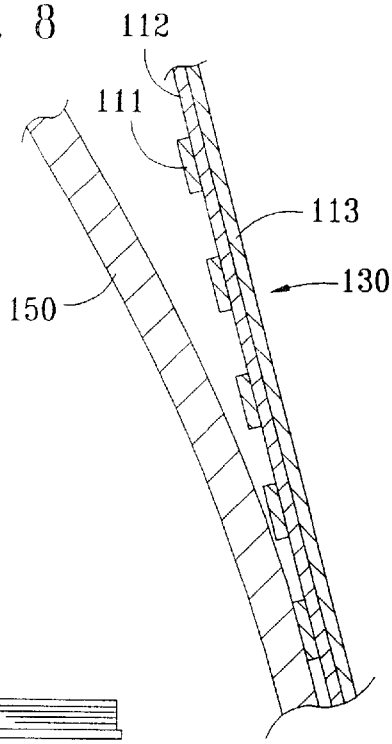
FIG. 8 is an enlarged partial side view section of a security laminate identification page of the passport booklet of FIG. 3.

FIGS. 7–11 illustrate cross sections of various possible identification document configurations. FIGS. 7 and 8 illustrate the configuration as previously described with regard to FIG. 3, just prior to the final lamination Step S7. FIGS. 7 and 8 illustrate the process as the silicon-coated release sheet 150 is removed from the security laminate 130. The final configuration of this example will result in the security laminate 130 being affixed to the data receiving sheet 180 that is affixed to the inside of the front cover 120.

FIG. 8 illustrates the silicon coated release sheet 150, printer toner 111 (consisting of approximately 90–95% polyester and 5–10% pigment), a polyethylene based copolymer adhesive 112, and a polyester security laminate cover 113.

Figure 9:
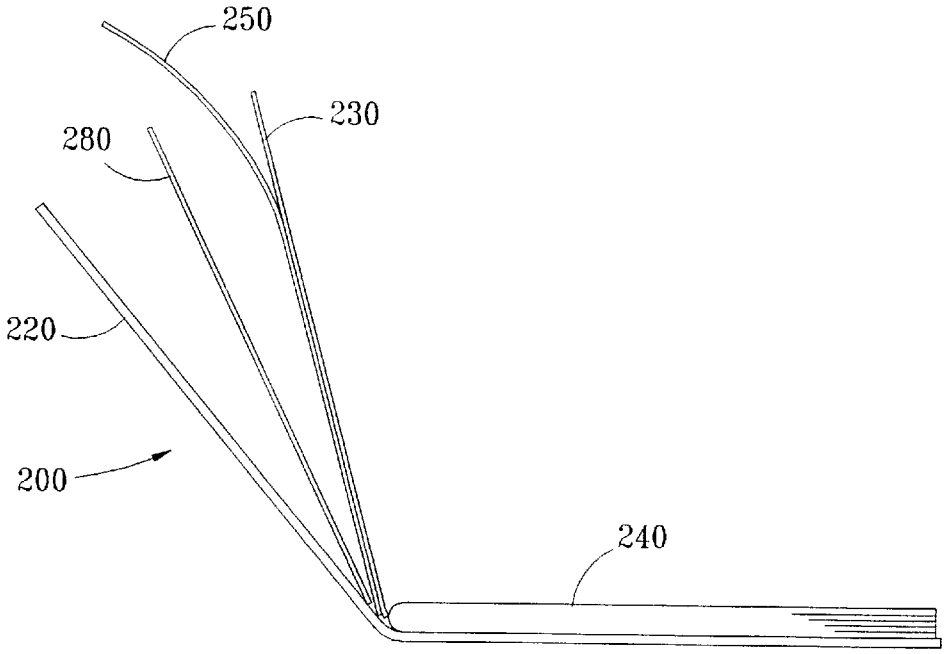
FIG. 9 is a side view of a passport booklet constructed according to a second embodiment of the method of the present invention.

FIG. 9 illustrates a second embodiment of the present invention, depicted at the same stage of the assembly as shown in FIG. 7 and 8. In this configuration, the security laminate 230 is sealed to an inner data receiving sheet 280 not affixed to the inside of the front cover 220 of the passport booklet 200. The location and side orientation of the data receiving sheet 280 is determined by the placement of the security laminate 230 during the fabrication process.

Figure 10:
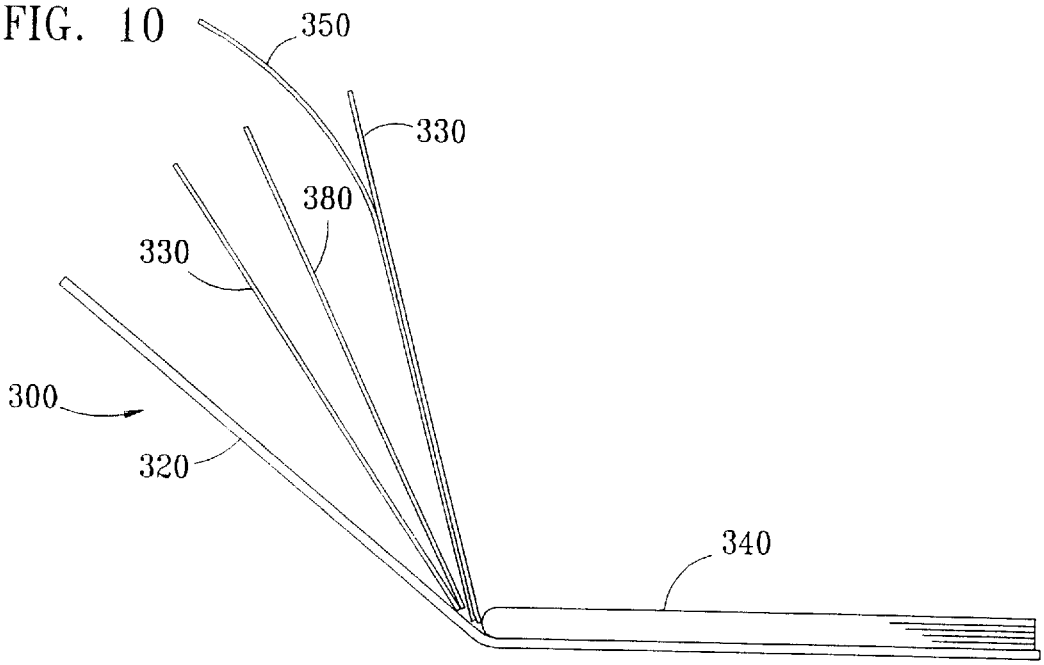
FIG. 10 is a side view of a passport booklet constructed according to a third embodiment of the method of the present invention.

FIG. 10 illustrates a third embodiment of the present invention. In this embodiment, the data receiving sheet 380 is sealed between two opposing layers of security laminates 330. Again, the location and side orientation of the data receiving sheet 380 is determined by the placement of the security laminates 330 during the fabrication.

Figure 11:
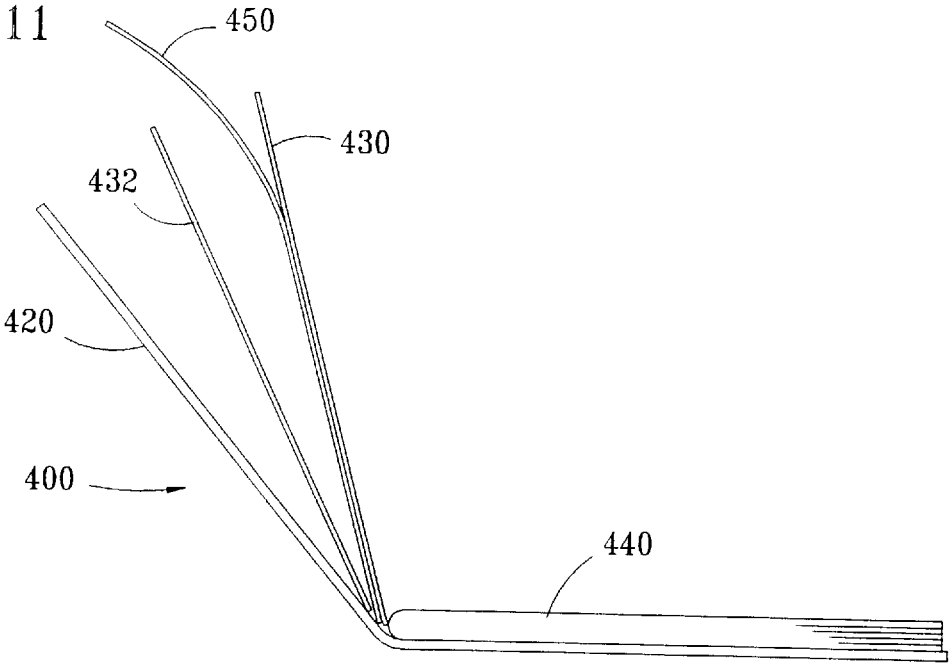
FIG. 11 is a side view of a passport booklet constructed according to a fourth embodiment of the method of the present invention.

A fourth embodiment is illustrated in FIG. 11. This embodiment does not utilize a security paper based data receiving sheet. Instead, the personalized data is transferred to a first security laminate 430 and then is sealed to a second security laminate 432. The personalized data is held in place between layers of adhesive of the opposing layers of an adhesive based security laminate 430 and 432 or is fused between opposing layers of non-adhesive based laminates.

Figure 12A:
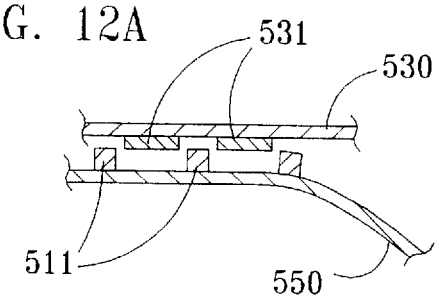
FIGS. 12A and 12B are side section views of an identification card constructed according to the present invention.
Figure 12B:
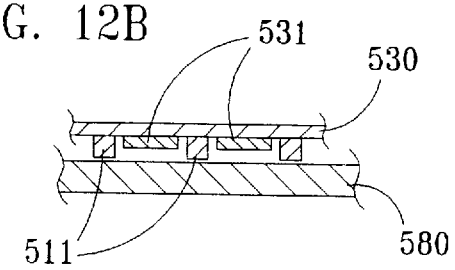

Referring to FIGS. 12A and 12B, an additional embodiment of the present invention is applicable to identification card documents 500. As used herein, identification card may include any type of verification card including but not limited to driver's license, school identification card, credit cards, and bank automatic teller machine cards. The personalized data 511 associated with an identification card 500 is printed onto a release sheet 550 and transferred to a transparent non-adhesive backed security laminate 530 receiving surface. Non-adhesive based security laminates include vinyls, PETG (polyester with a glycol additive), amorphous polyesters, or any transparent polymeric material with an appropriate softening temperature. The transparent security laminate 530 is then fused to a data receiving substrate 580 of polymeric material such as vinyl, PETG or amorphous polyester. This process has been demonstrated successfully on release sheets as large as 11" by 17". Eighteen to twenty-one identification cards may be accommodated on an eleven inch by seventeen inch sheet. For additional security, the transparent security laminate 530 includes security identification symbols 531 pre-printed or embossed thereon.

Figure 13:
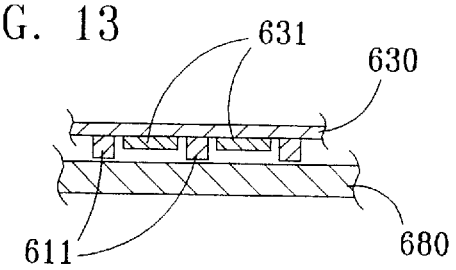
FIG. 13 is a side section view of an alternate identification card constructed according to an alternate method of the present invention.

Referring to FIG. 13 therein is disclosed an alternate embodiment of the security card of FIGS. 12A and 12B. The personalized data associated with an identification document is printed in reverse directly onto a silicon-coated release sheet 650. The printed silicon-coated release sheet 650 is positioned on a data receiving substrate 680 and passed through a laminator at an interface temperature of 125°–150° C. The data receiving substrate 680 includes vinyls, PETG and amorphous polyesters. When the silicon coated release sheet 650 is peeled away from the data receiving substrate 680, laser printer toner 611 (comprising 90% to 95% polyester and 5% to 10% pigment) is left on the data receiving substrate, thereby the personalized image 611 is transferred to the data receiving substrate 680.

Figure 14:
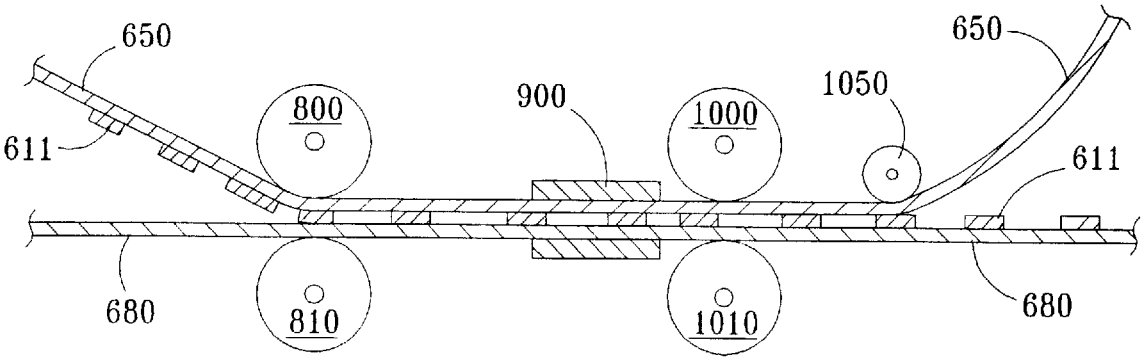
FIG. 14 is a side section view of an apparatus for constructing the identification card of FIG. 13.

The apparatus for transferring personalized data to the data receiving substrate 680 is shown FIG. 14. The silicon coated release sheet 550 having personalized data printed in reverse is fed through rollers 800 and 810. Heat is applied by a heater 900 and pressure is applied by compression rollers 1000 and 1010. The silicon-coated release sheet 650 is removed from the data receiving substrate 680 by stripper rollers 1050, leaving the personalized data in a transfer positive image 611 on the data receiving substrate 680.

Referring again to FIG. 13, a non-adhesive backed security laminate 630 is positioned over the data receiving substrate 680 containing the personalized data 611 and laminated to the substrate 680. Non-adhesive based security laminates include vinyls, PETG (polyester with a glycol additive), amorphous polyesters, or any transparent polymeric material with an appropriate softening temperature. The security laminate 630 includes security identification symbols 631 pre-printed or embossed thereon. It is to be understood that the technique described with regard to FIGS. 12A and 12B for constructing an identification card may also be used to transfer personalized data or an image to a vinyl substrate used for credit cards or bank debit cards. Furthermore, after personalized data is transferred to a vinyl substrate, the vinyl substrate may be vacuum molded into any shape, i.e., a cup, bowl, vase, etc.

Although the preferred and alternate embodiments of the invention have been illustrated in the accompanying Drawings and described in the foregoing Detailed Description, it will be understood that the invention is not limited to the embodiment disclosed but is capable of numerous modifications without departing from the scope of the invention as claimed.

I claim:

1. A method of making an identification document having a data receiving page for personalized data comprising the steps of:

(a) printing personalized data in the form of a fused toner directly onto a silicone release coat of a donor (b) positioning the donor release sheet with the side containing the fused toner, adjacent to a fusible receiving surface of a security laminate;

(c) laminating the release sheet and the security laminate thereby transferring the personalized data to the fusible receiving surface of the security laminate; and (d) removing the release sheet from the security laminate.

2. The method of claim 1 further including the step of: laminating the security laminate and the data receiving page thereby sealing personalized data between the security laminate and the data receiving page.

3. A method of making an identification document having a data receiving page for personalized data printed therein comprising the steps of:

(a) printing personalized data in the form of a fused toner directly onto a silicone release coat of a donor release sheet using a printer having a maximum and minimum fusing temperature;

(b) controlling the fusing temperature of the printer below the fusing temperature level that the print toner becomes brittle and above the minimum fusing temperature level required to fuse the toner to the silicon release coat;

(c) positioning the release sheet with the side containing the fused toner adjacent to a fusible receiving surface of a security laminate;

(d) laminating the release sheet and the security laminate thereby transferring the personalized data to the fusible receiving surface of the security laminate; and (e) removing the release sheet from the security laminate.

4. The method of claim 3, including the step of laminating the security laminate and the data receiving page thereby sealing the personalized data between the security laminate and the data receiving page.

5. The method of claim 3 wherein the step of laminating includes transferring the personalized data to a security laminate having a fusible thermoplastic receiving surface.

6. The method of claim 3 wherein the step of laminating includes transferring the personalized data to a polyester with a glycol additive receiving surface.

7. The method of claim 3 wherein the step of laminating includes transferring the personalized data to a vinyl receiving surface.

8. The method of claim 3 wherein the step of laminating includes transferring the personalized data to an amorphous polyester receiving surface.

9. A method of making an identification document having a data receiving page for personalized data comprising the steps of:

(a) printing personalized data in the form of a fused toner directly onto a silicone release coat of a donor release sheet;

(b) positioning the donor release sheet with the side containing the fused toner adjacent to a fusible receiving surface of a first security laminate;

(c) laminating the release sheet and the first security laminate thereby transferring the personalized data to the fusible receiving surface of the first security laminate;

(d) removing the release sheet from leaving the personalized data on the first security laminate;

(e) positioning the fusible receiving surface of the first security laminate adjacent to a first side of a data receiving page;

(f) positioning the fusible receiving surface of a second security laminate adjacent to a second side of the data receiving page; and (g) laminating passing the first security laminate, second security laminate and the data receiving page through a laminator thereby sealing the personalized data on the data receiving page between the first security laminate and the second security laminate.

10. A method of making an identification document for personalized data comprising the steps of:

(a) printing personalized data in the form of a fused toner directly onto a silicone release coat of a donor release sheet;

(b) positioning the donor release sheet with the side containing the fused toner adjacent to a fusible receiving surface of a first security laminate;

(c) laminating the release sheet and the first security laminate thereby transferring the personalized data to the fusible receiving surface of the first security laminate;

(d) removing the release sheet leaving the personalized data on the first security laminate;

(e) positioning the fusible receiving surface of the first security laminate adjacent to the fusible side of a second security laminate; and (f) laminating the first security laminate and second security laminate thereby sealing personalized data on the first security laminate between the first security laminate and the second security laminate.

11. A method of making a passport having personalized data printed therein, said passport including a cover, a data receiving page, and a security laminate having at least one fusible receiving surface, said security laminate positioned in the passport booklet with the fusible surface adjacent to the data receiving page, said method comprising the steps of:

(a) printing personalized data in the form of a fused toner directly onto the silicone release coat of a donor release sheet using a printing medium having a maximum and minimum fusing temperature;

(b) controlling the fusing temperature of the printer below the maximum fusing temperature level that the fused print toner becomes brittle and above the minimum fusing temperature level required to fuse the toner to the silicon release coat;

(c) positioning the donor release sheet with the side containing the fused toner adjacent to the fusible receiving surface of the security laminate;

(d) laminating passing the release sheet and the security laminate thereby transferring the personalized data to the fusible receiving surface of the security laminate;

(e) removing the release sheet from the security laminate; and (f) laminating the security laminate and the data receiving page.

12. A method of making an identification document having personalized data comprising the steps of:

(a) printing personalized data in the form of a fused toner directly onto a silicone release coat of a donor release sheet;

(b) positioning the donor release sheet with the side containing the fused toner adjacent to a receiving surface of a security laminate;

(c) laminating the release sheet and the security laminate thereby transferring the personalized data to the receiving surface of the security laminate;

(d) removing the release sheet from the security laminate;

(e) positioning a polymeric data receiving substrate adjacent to the receiving surface of the security laminate containing the personalized data; and (f) laminating the security laminate and the data receiving substrate thereby sealing personalized data between the security laminate and the data receiving substrate.

13. The method of claim 12 wherein the step of laminating the release sheet and the security laminate includes transferring the personalized data to a vinyl receiving surface.

14. The method of claim 12 wherein the step of laminating the release sheet and the security laminate includes transferring the personalized data to the receiving surface of the security laminate comprises a polyester with a glycol additive receiving surface.

15. The method of claim 12 wherein the step of laminating the release sheet and the security laminate includes transferring the personalized data to an amorphous polyester receiving surface.

16. The method of claim 12 wherein the step of laminating the release sheet and the security laminate includes transferring the personalized data to a vinyl receiving substrate.

17. The method of claim 12 wherein the step of laminating the release sheet and the security laminate includes transferring the personalized data to a polyester with a glycol additive receiving substrate.

18. The method of claim 12 wherein the step of laminating the release sheet and the security laminate includes transferring the personalized data to an amorphous polyester receiving substrate.

19. A method of making an identification document having personalized data comprising the steps of:

(a) printing personalized data in the form of a fused toner in reverse image directly onto a silicone release coat of a donor release sheet;

(b) positioning the donor release sheet with the side containing the fused toner adjacent to a polymeric data receiving substrate;

(c) laminating the release sheet and the polymeric substrate thereby transferring the personalized data in a positive image to the polymeric data receiving substrate;

(d) removing the release sheet leaving the personalized data on the polymeric data receiving substrate;

(e) positioning the polymeric data receiving substrate containing the personalized data adjacent to the receiving surface of a security laminate; and (f) laminating the security laminate and the polymeric data receiving substrate thereby sealing personalized data between the security laminate and the polymeric data receiving substrate.

20. The method of claim 19 wherein the step of laminating the release sheet and the security laminate includes transferring the personalized data to a vinyl receiving surface.

21. The method of claim 19 wherein the step of laminating the release sheet and the security laminate includes transferring the personalized data to a polyester with a glycol additive receiving surface.

22. The method of claim 19 wherein the step of laminating the release sheet and the security laminate includes transferring the personalized data to an amorphous polyester receiving surface.

23. The method of claim 19 wherein the step of laminating the release sheet and the security laminate includes transferring the personalized data to a vinyl receiving substrate.

24. The method of claim 19 wherein the step of laminating the release sheet and the security laminate includes transferring the personalized data to a polyester with a glycol additive receiving substrate.

25. The method of claim 19 wherein the step of laminating the release sheet and the security laminate includes transferring the personalized data to an amorphous polyester receiving substrate.

26. A method of making a verification card having personalized data comprising the steps of:

(a) printing personalized data in the form of a fused toner directly onto a silicone release coat of a donor release sheet;

(b) positioning the donor release sheet with the side containing the fused toner adjacent to the receiving surface of a security laminate;

(c) laminating the release sheet and the security laminate thereby transferring the personalized data to the receiving surface of the security laminate;

(d) removing the release sheet from the security laminate;

(e) positioning a polymeric verification card blank substrate adjacent to the receiving surface of the security laminate containing the personalized data; and (f) laminating the security laminate and the verification card blank substrate thereby sealing personalized data between the security laminate and the verification card blank substrate.

27. A method of making an article having personalized data comprising the steps of:

(a) printing personalized data in the form of a fused toner directly onto a silicone release coat of a donor release sheet;

(b) positioning the donor release sheet with the side containing the fused toner adjacent to the receiving surface of a security laminate;

(c) laminating the release sheet and the security laminate thereby transferring the personalized data to the receiving surface of the security laminate;

(d) removing the release sheet from on the security laminate;

(e) positioning a polymeric substrate adjacent to the receiving surface of the security laminate containing the personalized data;

(f) laminating the security laminate and the polymeric substrate thereby sealing personalized data between the security laminate and the polymeric substrate; and (g) vacuum forming the polymeric substrate and the security laminate containing the personalized data into a desired article shape.

28. A passport booklet having personalized data printed therein, said passport booklet including:

a cover;

a data receiving page; and a security laminate having at least one fusible receiving surface for receiving personalized data in the form of a fused toner from a silicone release coat of a donor release sheet, said security laminate positioned in the passport booklet with the fusible surface adjacent to the data receiving page.

29. An identification document having personalized data printed therein, said document including:

a data receiving page;

a fusible receiving surface; and a security laminate having at least one fusible receiving surface for receiving personalized data in the form of a fused toner from a silicone release coat of a donor release sheet, said security laminate positioned with the fusible surface adjacent to the data receiving page.

30. An identification document having personalized data printed therein, said document including:

a polymeric data receiving substrate;

a fusible receiving surface; and a security laminate having at least one fusible receiving surface for receiving personalized data in the form of a fused toner from a silicone release coat of a donor release sheet, said security laminate positioned with the fusible surface adjacent to the polymeric data receiving substrate.

31. An identification document having personalized data printed therein, said document including:

a polymeric verification card blank;

a fusible receiving surface; and a security laminate having at least one fusible receiving surface for receiving personalized data in the form of a fused toner from a silicone release coat of a donor release sheet, said security laminate positioned with the fusible surface adjacent to the polymeric verification card blank.

* * * * *

UNITED STATES PATENT AND TRADEMARK OFFICE

CERTIFICATE OF CORRECTION

PATENT NO. : 5,890,742

DATED : April 6, 1999

INVENTOR(S) : Robert A. Waller

It is certified that error appears in the above-identified patent and that said Letters Patent is hereby corrected as shown below:

On title page

References cited [56], col. 1, line 13, after "4,370,397", delete "1/1983", and insert --1/1993--.

References cited [56], col. 2, line 3, after "Line 10", insert --4,507,349 3/1985 Fromson et al--.

References cited [56] , page 2, line 14, delete "4,899,749 2/1990", and insert --4,889,749 12/1989--.

Claim 1, line 25, after "donor", insert --release sheet;--.

Claim 1, line 27, after "toner", delete ",".

Claim 9, line 20, after "from", delete "leaving the personalized data on".

Claim 9, line 28, after "laminating", delete "passing".

Claim 9, line 31, after "page", delete "through a laminator".

UNITED STATES PATENT AND TRADEMARK OFFICE

CERTIFICATE OF CORRECTION

PATENT NO. : 5,890,742

DATED : April 6, 1999

INVENTOR(S) : Robert A. Waller

It is certified that error appears in the above-identified patent and that said Letters Patent is hereby corrected as shown below:

Claim 11, line 7, after "laminating", delete "passing".

Claim 14, line 38, after "to", delete "the receiving surface of the security laminate comprises".

Claim 27, line 63, after "from", delete "on".

Signed and Sealed this

Twenty-eighth Day of March, 2000

*Attest:*

Q. TODD DICKINSON

*Attesting Officer*

*Commissioner of Patents and Trademarks*